United States Patent [19]

Hosie et al.

[11] Patent Number: 4,979,566

[45] Date of Patent: Dec. 25, 1990

[54] WASHOUT MECHANISM FOR OFFSHORE WELLS

[75] Inventors: Stanley Hosie, Houston, Tex.; John Anthony, Bridge of Don, Scotland

[73] Assignee: Vetco Gray Inc., Houston, Tex.

[21] Appl. No.: 499,050

[22] Filed: Mar. 26, 1990

[51] Int. Cl.[5] ..... E21B 21/00; E21B 34/12

[52] U.S. Cl. ..... 166/285.00; 166/312; 166/331; 166/332

[58] Field of Search ..... 166/285, 312, 382, 330, 166/331, 332

[56] References Cited

U.S. PATENT DOCUMENTS

| | | | |
|---|---|---|---|
| 4,625,799 | 12/1986 | McCormick et al. | 166/223 |
| 4,657,082 | 4/1987 | Ringgenberg | 166/331 |
| 4,848,457 | 7/1989 | Lilley | 166/332 |
| 4,856,592 | 8/1989 | Van Bilderbeek et al. | 166/285 |
| 4,928,772 | 5/1990 | Hopmann | 166/332 |

*Primary Examiner*—Stephen J. Novosad
*Assistant Examiner*—Terry Lee Melius
*Attorney, Agent, or Firm*—James E. Bradley

[57] ABSTRACT

A running tool for installing a casing hanger in a subsea conductor also serves to wash cement from the annulus surrounding the casing hanger. The running tool includes a tubular tool body which connects to a string of conduit. An internal sleeve mounts in the interior of the tool body for rotational movement only. A torque member lowers through the conduit to the internal sleeve for rotating the internal sleeve. A wash port extends from the interior of the tool body to the exterior of the tool body. An external sleeve mounts to the exterior of the tool body for axial movement between a closed position, closing the wash port, and an open position, opening the wash port. A linking mechanism between the internal and external sleeve causes rotary movement of the internal sleeve to move the external sleeve axially.

6 Claims, 4 Drawing Sheets

WASHOUT MECHANISM FOR OFFSHORE WELLS

BACKGROUND OF THE INVENTION

1. Field of the Invention

This invention relates in general to offshore drilling systems, and in particular to a system for washing out the annulus surrounding a casing hanger when installing casing in conductor pipe with a jackup drilling rig.

2. Description of the Prior Art:

In one type of offshore drilling, jackup drilling rigs are used. Typically 30 inch diameter conductor pipe will extend from the drilling rig to a selected depth in the well. Then the operator will drill the well to a greater depth and install 20 inch diameter casing. In one technique, a casing hanger will be secured to the upper end of the string of 20 inch casing The casing hanger lands on a shoulder in the 30 inch conductor approximately at the sea floor. The operator lowers the casing hanger and string of casing with a running tool. Then the operator will pump cement down the string of casing to return up the annulus between the casing and the conductor.

After cementing, the operator will need to wash out the casing in the annulus area surrounding the casing hanger In the past, one technique used was to unscrew the running tool from the casing hanger a selected amount. This exposed wash ports leading from the interior of the running tool string to the exterior of the casing hanger. The operator would pump water down to flow out the wash ports and clean the cement from around the casing from the wash ports upward.

In U.S. Pat. No. 4,856,592, an internal sleeve locates within the running tool. The operator runs a torque member from the drilling rig down to the running tool. The torque member engages a slot on the internal sleeve. The operator rotates the torque member to rotate the sleeve. The sleeve is secured by threads to the running tool. The rotation causes the sleeve to move axially upward to expose wash ports in the running tool.

SUMMARY OF THE INVENTION

In this invention, an axially movable external sleeve locates on the exterior of the running tool. An internal sleeve mounts to the interior of the running tool so that it will rotate only, and not move axially A torque member will engage a slot in the internal sleeve. The internal sleeve and the external sleeve are linked together with a means which causes the external sleeve to move axially when the internal sleeve rotates. This opens and closes a washout port.

In one embodiment of the invention, the linking mechanism between the internal and external sleeve comprises threads The threads of the external sleeve are formed on lugs which locate within slots in an upper portion of a lower tool body. These threads engage circumferential threads of the internal sleeve.

In a second embodiment, the linking mechanism between the internal and external sleeves comprises a cam slot and a cam pin. The cam pin extends through an elongated aperture in the lower running tool body. The cam slot extends circumferentially and axially so that rotational movement will cause the external sleeve to move axially.

DETAILED DESCRIPTION OF THE INVENTION

Figure 1:
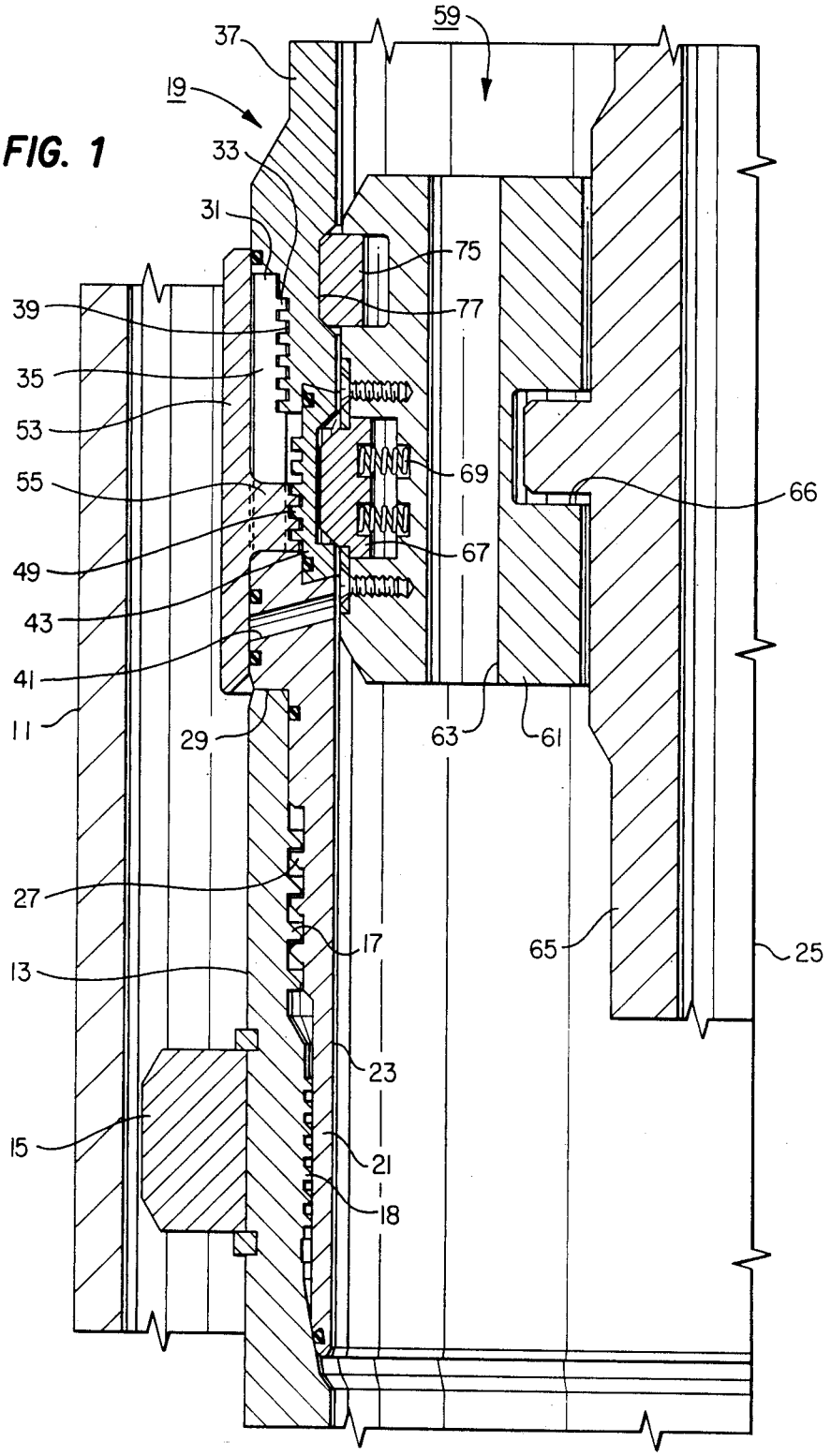
FIG. 1 is a quarter sectional view illustrating a casing hanger running tool constructed in accordance with this invention, and shown with the external sleeve in a closed position.

Referring to FIG. 1, 30 inch conductor conduit 11 will extend from a jackup drilling rig (not shown) into the subsea floor a selected distance. After the conductor 11 has been installed, the operator will drill to a greater depth. The operator will then install smaller diameter casing, such as 20 inch diameter casing (not shown) Casing hanger 13 will be located on the upper end of the string of 20 inch diameter casing. Casing hanger 13 is a tubular member that has an external ring 15 for landing on a shoulder (not shown) in the conductor 11. The shoulder will be located approximately at the sea floor level Casing hanger 13 has a bore containing a set of threads 17. Threads 17 serve as means for connecting the casing hanger 13 to a running tool 19. A second set of threads 18 are formed in the bore of casing hanger 13 below the threads 17. Threads 18 will be used to subsequently secure a tieback connector (not shown).

Running tool 19 has a lower tool body 21. The lower tool body 21 has an axial bore 23 The axis is indicated by the numeral 25. A set of external threads 27 on the lower tool body 21 engages the threads 17 in the casing hanger 13. A downward facing shoulder 29 contacts the upper rim of the casing hanger 13. The lower end of the lower tool body 21 extends downward past the tieback threads 18 and has a seal which seals to the casing hanger 13 below the tieback threads 18 to protect the tieback threads 18.

Figure 3:
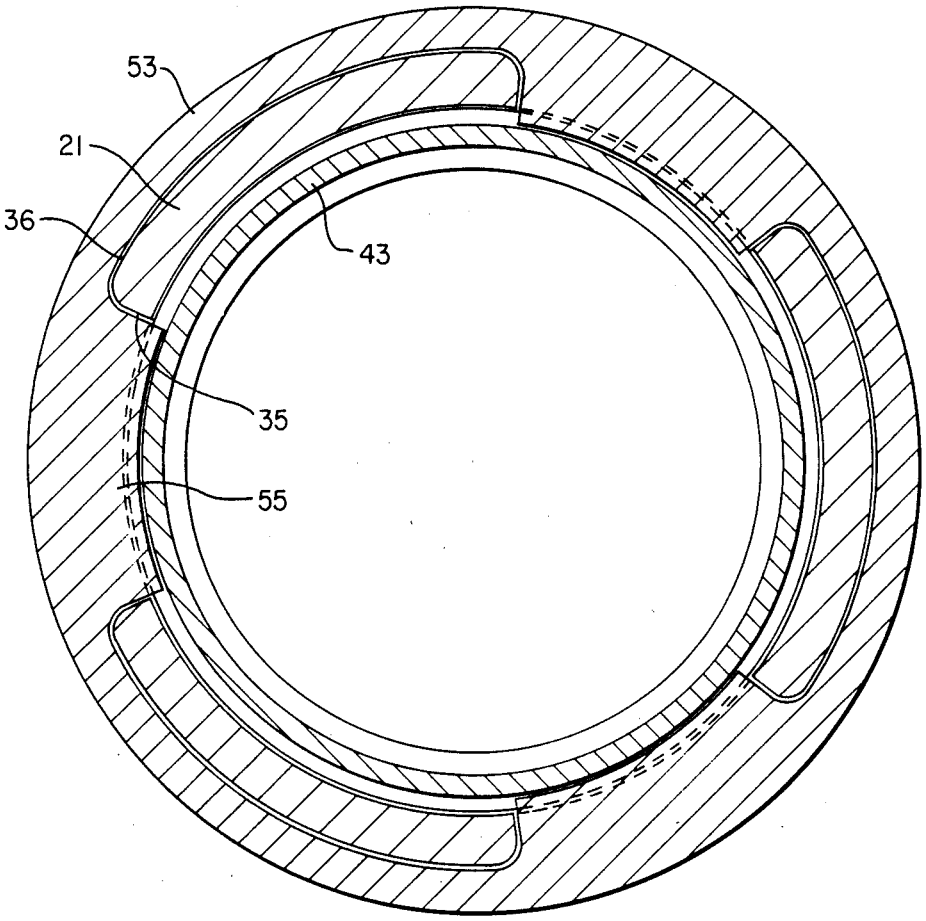
FIG. 3 is a sectional view of the running tool of FIG. 2, taken along the line III—III, and with the torque member removed.

The lower tool body 21 extends upward from the casing hanger 13, terminating in an upper end 31. A set of threads 33 will be formed in the interior of the lower tool body 21 near the upper end 31. A plurality of vertical slots 35 extend from the upper end 31 downward a selected distance These slots 35 extend completely through the lower tool body 21 from the bore 23 to the exterior, defining upward extending fingers 36 (FIG. 3). Preferably there are three fingers 36, each extending circumferentially about 80 degrees. There are three slots 35, each extending circumferentially about 40 degrees.

An upper tool body 37 connects by threads 39 to the lower tool body threads 33. The upper tool body 37 secures to the lower end of a string of casing (not shown). This string of casing will be used to lower the running tool 19 and casing hanger 13 into the well.

A plurality of wash ports 41 (only one shown) extend through the lower tool body 21 from the bore 23 to the exterior. Each wash port 41 locates a short distance above the shoulder 29. Seals 42 (FIG. 2) provide sealing for the exterior of each wash port 41.

An internal sleeve 43 mounts on the interior of the lower tool body 21. Internal sleeve 43 has a lower end which locates within a recess 45 (FIG. 2) in the lower tool body 21 immediately above the wash ports 41. The upper edge of the internal sleeve 43 slidably locates within a recess 47 located in the lower end of the upper tool body 37. The upper and lower edges of the internal sleeve 43 are slightly conical so as to assure that the internal sleeve 43 will be retained by the lower tool body 21 and upper tool body 37. The recesses 45, 47 serve as means to allow the internal sleeve 43 to rotate, but prevent any axial movement of the internal sleeve 43 relative to the lower tool body 21.

Internal sleeve 43 has exterior threads 49 The exterior threads 49 are located radially inward of the fingers 36 defined by the slots 35 of the lower tool body 21. Access to the threads 49 will be provided by the slots 35 in the lower tool body 21. A plurality of internal slots 51, preferably four, extend vertically along the inner diameter of the internal sleeve 43 Slots 51 do not extend completely through the internal sleeve 43.

Figure 2:
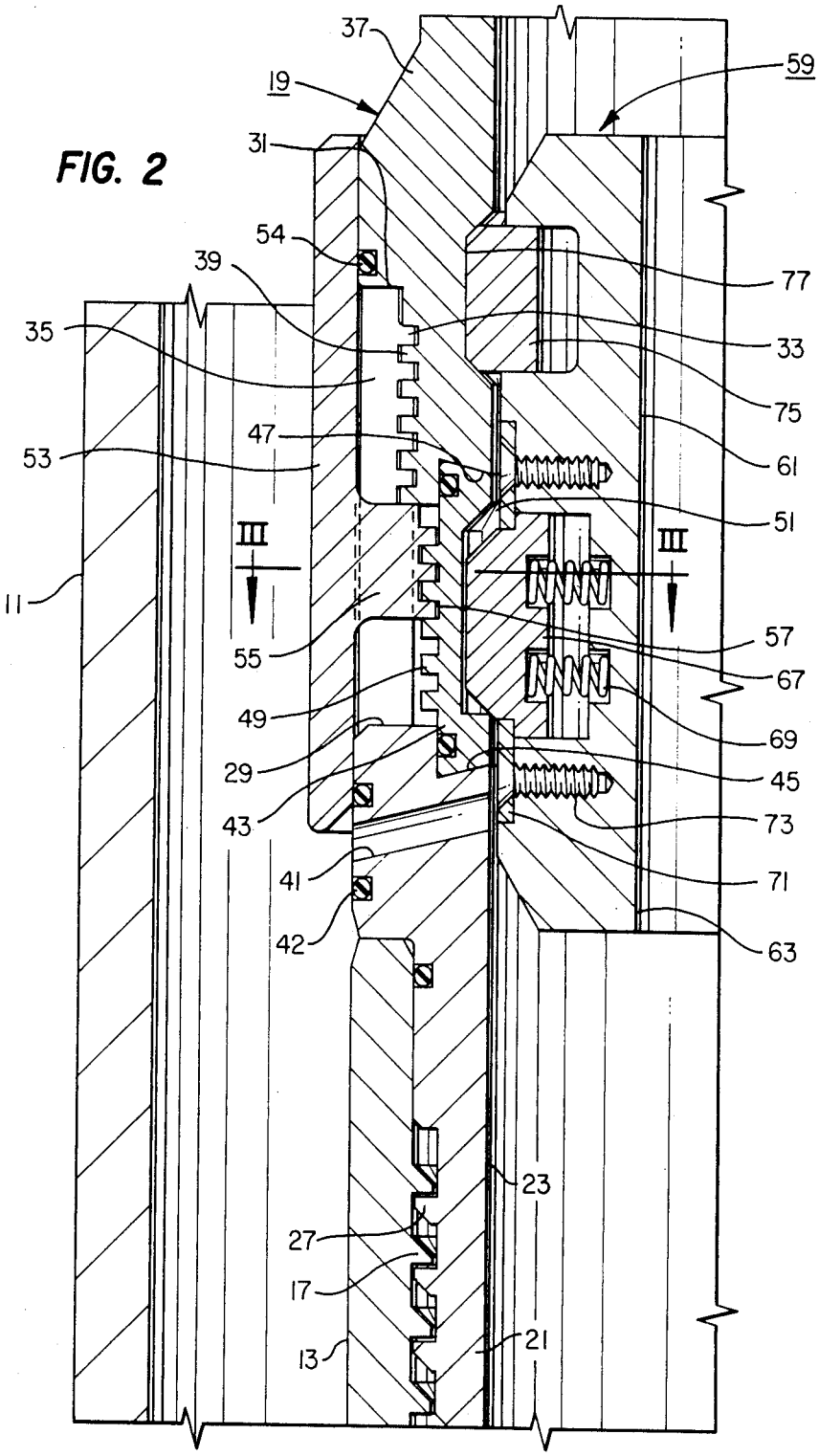
FIG. 2 is a partial quarter sectional view of the running tool as shown in FIG. 1, but with the external sleeve shown in an open position

An external sleeve 53 locates on the exterior of the lower tool body 21 and upper tool body 37. External sleeve 53 will more axially relative to the lower tool body 21 and upper tool body 37. In the position shown in FIG. 1, the external sleeve 53 closes the wash ports 41. In FIG. 2, the external sleeve 53 opens the wash ports 41. Seals 54 seal the external sleeve 53 to the exterior of the lower tool body 21 and upper tool body 37.

The external sleeve 53 has a plurality of lugs 55 The lugs 55 are spaced circumferentially from each other and protrude radially inward The lugs 55 will locate in the slots 35 in the lower tool body 21. The fingers 36 and lugs 55 serve as means to mount the external sleeve 53 for axial movement, but prevent any rotational movement of the external sleeve 53 relative to the lower tool body 21. The lugs 55 have threads 57 on the interior. Threads 57 engage the threads 49 on the internal sleeve 43. Rotating the internal sleeve 43 thus will cause the external sleeve 53 to move upward or downward.

The means for rotating the internal sleeve 43 comprises a torque member 59 which will be run after the casing hanger 13 has been run on the upper tool body 37 and lower tool body 21. The torque member 59 may be considered a part of the running tool 19 even though it is run at a later time than the other portions of the running tool 19. The torque member 59 has a body 61 with vertical passages 63 extending through it. Drill pipe 65 will extend downward from the drilling rig and position in the body 61 within a J-slot 66, which is not shown in detail. The lower end of drill pipe 65 will have a cementing stinger (not shown) for engaging a cementing shoe (not shown) located at the lower end of the casing which extends downward from casing hanger 13.

A plurality of dogs 67, preferably four, will be used to engage the slots 51 in the internal sleeve 43. The dogs 67 locate on the exterior of the body 61. Springs 69 bias the dogs 67 outward. A retainer plate 71, shown in FIG. 2, retains each dog 67 with the body 61. Screws 73 hold the retainer plate 71 to the body 61. A split ring 75 will snap out into a recess 77 located in the upper tool body 37 to land the torque member 59 in the internal sleeve 43.

In the operation of the embodiment of FIG. 1, the casing hanger 13 will be secured to the upper end of a string of 20 inch casing (not shown). The lower tool body 21 and the upper tool body 37 will be secured together and to the casing hanger 13. The external sleeve 53 will be in the closed position The entire assembly will be lowered into the well on a string of casing (not shown) which secures to the upper tool body 37.

After the casing hanger 13 lands in the conductor 11, the operator will run the torque member 59 on a string of drill pipe 65. The torque member 59 will engage the recess 77, which prevents further downward movement of the body 61. The operator will then rotate the drill pipe 65 to disengage the drill pipe 65 from the J-slot 66. The operator lowers the drill pipe 65 until the stinger (not shown) on the lower end of the drill pipe 65 engages the cementing shoe (not shown). The operator will pump cement down the drill pipe 65, which flows back up the annulus surrounding the 20 inch casing. The cement may flow upward past the wash ports 41.

Before the cement sets, the operator pulls the drill pipe 65 back upward and engages the J-slot 66. The operator rotates the drill pipe 65, causing the body 61 to rotate. The dogs 67 will engage the slots 51 in the internal sleeve 43 and cause the internal sleeve 43 to rotate with the torque member 59.

The threads 49 will cause the external sleeve 53 to move upward to the open position shown in FIG. 2. The operator then pumps water down the drill pipe 65. The water flows out the lower end of the drill pipe 65 and back up the 20 inch casing. The water flows through the passages 63 and fills the 20 inch casing extending upward from the upper tool body 37. The operator closes a valve (not shown) at the upper end of the 20 inch casing, thereby closing the upper end of the annulus surrounding the drill pipe 65. This allows pressure to be applied to the water in the 20 inch casing This causes the water to flow out the wash ports 41 to circulate up the conductor 11 to the drill rig. This washes the cement from the vicinity of the running tool 19.

The operator will then close the wash ports 41 by rotating the torque member 59 in the opposite direction. He then retrieves the torque member 59 by pulling upward. The operator then may continue drilling through the 20 inch casing.

Figure 4:
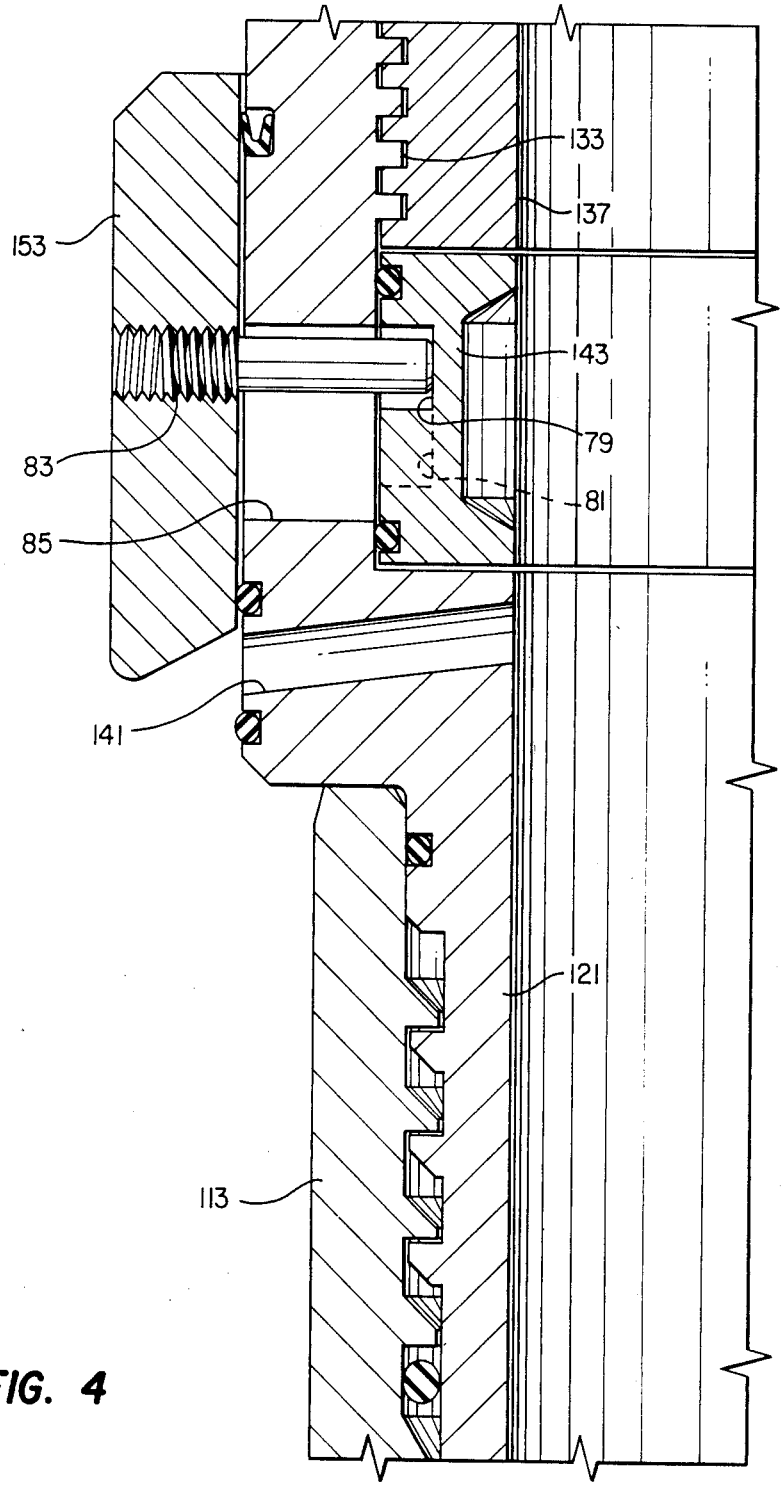
FIG. 4 is a quarter sectional view of an alternate embodiment of a running tool constructed in accordance with this invention.

In the alternate embodiment of FIG. 4, casing hanger 113 will be supported by a lower tool body 121. Threads 133 on the upper end of the lower tool body 121 connect the lower tool body 121 to an upper tool body 137. A wash port 141 extends through the lower tool body 121. Internal sleeve 143 will rotate, but is held against axial movement by the lower end of the upper tool body 137 and by an upward facing shoulder in the lower tool body 121.

A cam slot 79 will be formed on the exterior of the internal sleeve 143. Cam slot 79 extends circumferentially a selected distance around the external sleeve 153. It also inclines an axial direction, thus is partially helical. Dotted lines 81 indicate this helical inclination of the cam slot 79.

A cam pin 83 extends through an axially elongated aperture 85 in the lower tool body 121. Cam pin 83 is rigidly secured to external sleeve 153 and extends radially inward from external sleeve 153 Aperture 85 is only slightly greater in width than the diameter of the cam pin 83. However, it is much greater in axial length. The aperture 85 allows the cam pin 83 to move upward and downward relative to the lower tool body 121, but prevents any rotational movement of the external sleeve 153.

In the operation of the embodiment of FIG. 4, the torque member 59 (not shown in FIG. 4) rotates the internal sleeve 143. This causes the cam pin 83 to advance along the cam slot 79, to move the external sleeve 153 axially in an upward or downward direction The invention has significant advantages The external sleeve mechanism avoids the need for unscrewing the running tool from the casing hanger even partially for exposing the wash port.

While the invention has been shown in only two of its forms, it should be apparent to those skilled in the art that it is not so limited, but is susceptible to various changes without departing from the scope of the invention.

We claim:

1. A running tool for installing a casing hanger in a subsea tubular conductor, the casing hanger being connected to the upper end of a string of casing for landing in the tubular conductor, the running tool comprising in combination:

a tubular tool body adapted to be connected to a string of conduit;

means on the tool body for releasably connecting the tool body to the casing hanger for lowering the casing string into the tubular conductor and landing the casing hanger in the tubular conductor;

an internal sleeve;

means for mounting the internal sleeve in the interior of the tool body for rotational movement only relative to the tool body;

a torque member adapted to be lowered through the conduit to the internal sleeve;

means on the torque member for engaging the internal sleeve to cause the internal sleeve to rotate when the torque member is rotated;

at least one wash port extending from the interior of the tool body to the exterior of the tool body;

an external sleeve mounted to the exterior of the tool body for axial movement between a closed position in which the wash port is closed, and an open position in which the wash port is opened to allow cement surrounding the casing hanger to be washed out by pumping a fluid down the conduit; and means for linking the internal sleeve and the external sleeve, whereby rotational movement of the internal sleeve to move the external sleeve axially.

2. A running tool for installing a casing hanger in a subsea tubular conductor, the casing hanger being connected to the upper end of a string of casing for landing in the tubular conductor the running tool comprising in combination:

a tubular tool body adapted to be connected to a string of conduit;

means on the tool body for releasably connecting the tool body to the casing hanger for lowering the casing string into the tubular conductor and landing the casing hanger in the tubular conductor;

an internal sleeve;

means for mounting the internal sleeve in the interior of the tool body for rotational movement only relative to the tool body;

a set of threads located on the exterior of the internal sleeve;

at least one slot located in the interior of the internal sleeve;

a torque member adapted to be lowered through the conduit to the internal sleeve;

means on the torque member for engaging the slot in the internal sleeve to cause the internal sleeve to rotate when the torque member rotates;

at least one wash port extending from the interior of the tool body to the exterior of the tool body;

an external sleeve mounted to the exterior of the tool body for axial movement between a closed position in which the wash port is closed, and an open position in which the wash port is opened to allow cement surrounding the casing hanger to be washed out by pumping a fluid down the conduit;

a set of threads on the interior of the external sleeve in engagement with the threads on the exterior of the internal sleeve; and means on the external sleeve and the tool body for preventing rotational movement of the external sleeve relative to the tool body, whereby rotation of the internal sleeve by the torque member causes the external sleeve to move axially.

3. A running tool for installing a casing hanger in a subsea tubular conductor, the casing hanger being connected to the upper end of a string of casing for landing in the tubular conductor, the running tool comprising in combination:

a tubular upper tool body adapted to be connected to a string of conduit and having a lower end containing a set of threads;

a tubular lower tool body having an upper end containing a set of threads for engaging the threads of the upper tool body;

means on the lower tool body for releasably connecting the lower tool body to the casing hanger for lowering the casing string into the tubular conductor and landing the casing hanger in the tubular conductor;

a plurality of vertical slots extending through the threads of the lower tool body;

an internal sleeve;

means for mounting the internal sleeve in the interior of the lower tool body radially inward from the slots in the lower tool body for rotational movement only relative to the lower tool body;

a set of threads located on the exterior of the internal sleeve;

at least one slot located in the interior of the internal sleeve;

a torque member adapted to be lowered through the conduit to the internal sleeve;

at least one dog on the torque member for engaging the slot in the internal sleeve to cause the internal sleeve to rotate when the torque member is rotated;

at least one wash port extending from the interior of the lower tool body to the exterior of the lower tool body below the internal sleeve;

an external sleeve;

means for mounting the external sleeve to the exterior of the lower tool body for axial movement relative to the lower tool body between a closed position in which the wash port is closed and an open position in which the wash port is opened, to allow cement surrounding the casing hanger to be washed out by pumping a fluid down the conduit;

a plurality of circumferentially spaced apart lugs extending radially inward from the external sleeve which mesh with the slots of the lower tool body; and a set of threads on the lugs of the external sleeve which engage the threads on the exterior of the internal sleeve, so that rotation of the internal sleeve by the torque member causes the external sleeve to move axially.

4. A running tool for installing a casing hanger in a subsea tubular conductor, the casing hanger being connected to the upper end of a string of casing for landing in the tubular conductor, the running tool comprising in combination:

a tubular tool body adapted to be connected to a string of conduit;

means on the tool body for releasably connecting the tool body to the casing hanger for lowering the casing string into the tubular conductor and landing the casing hanger in the tubular conductor;

an internal sleeve;

means for mounting the internal sleeve in the interior of the tool body for rotational movement only relative to the tool body;

a torque member adapted to be lowered through the conduit to the internal sleeve;

means on the torque member for engaging the internal sleeve to cause the internal sleeve to rotate when the torque member rotates;

at least one wash port extending from the interior of the tool body to the exterior of the tool body;

an external sleeve mounted to the exterior of the tool body for axial movement relative to the tool body between a closed position in which the wash port is closed, and an open position in which the wash port is opened to allow cement surrounding the casing hanger to be washed out by pumping a fluid down the conduit;

an axially elongated aperture extending through the tool body between the internal sleeve and the external sleeve;

a cam slot formed selectively in one of the sleeves, the cam slot extending circumferentially and vertically a selected distance;

a cam pin mounted to the other of the sleeves and extending through the aperture into engagement with the cam slot, whereby rotational movement of the internal sleeve causes the cam pin to slide along the cam slot to move the external sleeve axially 5. A running tool for installing a casing hanger in a subsea tubular conductor, the casing hanger being connected to the upper end of a string of casing for landing in the tubular conductor, the running tool comprising in combination a tubular tool body adapted to be connected to a string of conduit;

means on the tool body for releasably connecting the tool body to the casing hanger for lowering the casing string into the tubular conductor and landing the casing hanger in the tubular conductor;

an internal sleeve mounted in the interior of the tool body for rotational movement only;

a torque member adapted to be lowered through the conduit to the internal sleeve;

means on the torque member for engaging the internal sleeve to cause the internal sleeve to rotate when the torque member rotates;

at least one wash port extending from the interior of the tool body to the exterior of the tool body;

an external sleeve mounted to the exterior of the tool body for axial movement relative to the tool body between a closed position in which the wash port is closed, and an open position in which the wash port is opened to allow cement surrounding the casing hanger to be washed out by pumping a fluid down the conduit;

an axially elongated aperture extending through the tool body between the internal sleeve and the external sleeve;

a cam slot formed on the exterior of the inner sleeve, the cam slot extending circumferentially and vertically a selected distance;

a cam pin mounted to the interior of the external sleeve and extending radially through the aperture into engagement with the cam slot, whereby rotational movement of the internal sleeve causes the cam pin to slide along the cam slot to move the external sleeve axially.

6. A method for installing a casing hanger connected to a string of casing in a subsea tubular conductor, comprising the following steps:

connecting a tubular tool body to a string of conduit;

releasably connecting the tool body to the casing hanger;

mounting an internal sleeve in the interior of the tool body for rotational movement only relative to the tool body;

providing at least one wash port extending from the interior of the tool body to the exterior of the tool body;

mounting an external sleeve to the exterior of the tool body for axial movement between a closed position in which the wash port is closed and an opened position in which the wash port is opened;

linking the internal sleeve with the external sleeve, whereby rotational movement of the internal sleeve to move the external sleeve axially;

lowering the casing hanger into the tubular conductor with the tool body and the string of conduit;

lowering a torque member on a string of pipe through the conduit into engagement with the internal sleeve;

cementing the string of casing in the tubular conductor by pumping cement down the string of pipe and string of casing and back up an annulus surrounding the string of casing; then rotating the torque member with the string of pipe to cause the internal sleeve to rotate and move the external sleeve to the opened position; then pumping a fluid down the string of pipe and into the conduit to flow out the wash port and clean out a portion of the annulus.

* * * * *

UNITED STATES PATENT AND TRADEMARK OFFICE

CERTIFICATE OF CORRECTION

PATENT NO. : 4,979,566

DATED : 12/25/90

INVENTOR(S) : Stanley Hosie, et al

It is certified that error appears in the above-identified patent and that said Letters Patent is hereby corrected as shown below:

On the title page item [75], "John Anthony" should be --John Anthony Ibbotson--.

At column 1, line 19, a period follows the first occurrence of "casing";
At column 1, line 29, a period follows "hanger";
At column 1, line 58, a period follows the first occurrence of "threads";
At column 2, line 9, a period follows "position";
At column 2, line 24, a period follows "(not shown)";
At column 2, line 30, a period follows "level";
At column 2, line 38, a period follows "23";
At column 2, line 52, a period follows "distance";
At column 3, line 14, a period follows "49";
At column 3, line 20, a period follows "43";
At column 3, line 30, a period follows "55";
At column 3, line 32, a period follows "inward";
At column 4, line 1, a period follows "position";
At column 4, line 32, a period follows "casing";
At column 4, line 59, a period follows "153";
At column 5, line 3, a period follows "advantages";
At column 5, line 44, "to move" should be--moves--;
At column 7, line 48, a colon follows "combination";
At column 8, line 43, "to move" should be--moves--.

Signed and Sealed this

First Day of December, 1992

*Attest:*

DOUGLAS B. COMER

*Attesting Officer*

*Acting Commissioner of Patents and Trademarks*